US006981329B1

(12) United States Patent
Strathman

(10) Patent No.: US 6,981,329 B1
(45) Date of Patent: Jan. 3, 2006

(54) FIBER OPTIC PEEP SIGHT

(76) Inventor: David Michael Strathman, 1535 St. Loretto Dr., Florissant, MO (US) 63033

( * ) Notice: Subject to any disclaimer, the term of this patent is extended or adjusted under 35 U.S.C. 154(b) by 0 days.

(21) Appl. No.: 10/746,748

(22) Filed: Dec. 26, 2003

(51) Int. Cl.
*F41G 1/467* (2006.01)

(52) U.S. Cl. ..... 33/265; 124/87

(58) Field of Classification Search ..... 33/265; 124/87
See application file for complete search history.

(56) References Cited

U.S. PATENT DOCUMENTS

| | | | | |
|---|---|---|---|---|
| 3,199,502 A | | 8/1965 | Stonecipner | |
| 3,703,771 A | | 11/1972 | Saunders | |
| 3,859,733 A | | 1/1975 | Chesnick | |
| 4,011,853 A | | 3/1977 | Fletcher | |
| 4,116,194 A | | 9/1978 | Topel | |
| 4,563,821 A | * | 1/1986 | Saunders | 33/265 |
| 5,056,498 A | | 10/1991 | Scherz | |
| 5,080,084 A | * | 1/1992 | Kendall et al. | 124/87 |
| 5,148,603 A | | 9/1992 | Beutler | |
| 5,325,598 A | | 7/1994 | Hall | |
| 5,347,976 A | | 9/1994 | Saunders | |
| 5,464,003 A | * | 11/1995 | Sherman | 124/87 |
| 5,671,724 A | * | 9/1997 | Priebe | 124/87 |
| 5,791,060 A | * | 8/1998 | Godsey | 33/265 |
| 5,996,569 A | | 12/1999 | Wilson | |
| 6,058,921 A | | 5/2000 | Lawrence | |
| 6,082,012 A | * | 7/2000 | McLeod | 33/265 |
| 6,282,800 B1 | | 9/2001 | Beutler | |
| 6,477,778 B1 | * | 11/2002 | Lorocco | 33/265 |

OTHER PUBLICATIONS

The Classic Scope, website information dated May 26, 2002.*

Effective Aiming Systems by Bob Rob. Bob Robb's Columns (Sighting Systems). http://www.bowhunting.net/bobrobb/bob3.html p. 1 of 6.

Tech Bulletin from: The Bowman http://www.thebowman.com/&bpeep.html Subject: Peep Sights p. 2 of 3 Aiming With A Peep Sight.

News Letter 3, Spot-Hogg's Attitude on Aiming. http://www.spot-hogg.com/newsletter_3.htm Spot-Hogg Archery Products, Harrisburg, OR 97446.

Ask Mossy Oak by Bill Winke. A New Way to Aim. http://www.bowhuntingmag.com/ask/ask_winke/.

* cited by examiner

*Primary Examiner*—Christopher W. Fulton
*Assistant Examiner*—Tania Courson
(74) *Attorney, Agent, or Firm*—Haverstock, Garrett & Roberts LLP

(57) ABSTRACT

An improved bowstring mounted peep sight used in archery improving archer's accuracy. The present invention preferred embodiment having a body generally horizontal within bowstring axis has through the body centrally located luminous color optic cross-pieces indexing the center of the peep sight aperture. The characteristic of the present invention optic cross-pieces fiber side lit attenuation allows the archer to easily see through the large aperture peep sight aligning forward bow sight pin on color cross-pieces sectional center aperture small highlighted index reference window. Small reference index window cross hair center provides consistent centering reference within the large aperture by proximal blur designed within Fiber Optic Peep Sight. A second characteristic is both peep sight embodiment and optic cross-piece fibers be further enhanced with florescent light collecting glow pigment, dyes or other color illuminating materials for increased viewing during less than desirable lighting conditions.

52 Claims, 7 Drawing Sheets

FIBER OPTIC PEEP SIGHT

BACKGROUND OF THE INVENTION

1. Field of the Invention

This invention relates to a bowstring mounted archery peep sight, specifically an improved designed peep aperture with a fiber optic cross hair.

2. Description of Related Art

Bowstring mounted peep sights enable the archer to sight his or her shot viewing through the peep sight open aperture. It is convenient for the archer to sight his forward sight pin within the center of said aperture opening for a more readily consistent and accurate shot. The method and design of bowstring mounted peep sights generally split the center of the bowstring axis allowing the archer to view through the string verse through the blur of the string without such mounted peep sight.

Therefore, early conventional bowstring peep sights where vertically mounted in bowstring axis. This design can be referred in U.S. Pat. No. 3,199,502 (1965) to Opal and U.S. Pat. No. 3,703,771 (1975) to Saunders. These vertical bowstring mounted peep sights became ineffective with today's newer bows varied draw and axial lengths.

Presently the traditional available peep sights are designed to mount on bowstring with varied embodiments, angles and method of attachment to bowstrings to accommodate the more modern traditional compound bowstring draw and axial lengths. These provided a direct improvement from the fore mentioned conventional vertical string mounted peep sights. Traditional bowstring mounted peep sights vary with vertical and horizontal angular string mounting with angular offset peep holes providing improvement for varied draw and axial bow lengths. These varied traditional peeps sights can be referred in U.S. Pat. No. 3,859,733 (1973) to Chesnick, U.S. Pat. No. 4,011,853 (1977) to Fletcher, U.S. Pat. No. 4,116,194 (1978) to Topel, U.S. Pat. No. 5,347,976 (1994) to Saunders and U.S. Pat. No. 6,058,921 (2000) to Lawrence. As can be seen, the traditional fore mentioned peep sights made improvement over the conventional peep sight problem with bow draw and axial length angles, however still peep sight aperture viewing remained limited to small peep aperture hole for target and large peep aperture hole for hunting. Small peep sight aperture applications remain subject to visual target loss in medium to low light conditions typical outdoors and hunting in wooded terrain, leaving the hunter only to use a larger peep aperture application for better visual clarity and targeting visibility. The problem presented with the larger peep aperture hole application designs is it now remains a contributing factor to loss of arrow accuracy with the archer failing to center forward sight pin in the center of the larger aperture peep sight hole. However, the larger aperture peep providing improvement towards improved visibility during less than desirable light conditions, it remains a counter productive solution having to substitute the accuracy provided of the smaller peep aperture for the visibility provided that of the larger peep aperture design. Peep sight designs have generally remain today for target applications; pin hole size peeps, clarifier peeps, peeps with inserts, small to medium peep hole sizes for target and medium to large peep hole sizes for hunting and 3 D shooting.

Thereafter, inventors created several types and designs of peep sights in effort in increase archers shooting accuracy but remained limited to specific peep hole sizes for each general application, that of small peep aperture size for target and large for hunting. With many different type peep sights on the market, some are better for indoor target shooting, others for hunting and 3D outdoors. The type of light available is really the question when deciding on a peep. If used for hunting in dim light situations a larger hole will be needed. For indoor target with good lighting a smaller one will probably be best (usually) the smaller the better for shooting dots or tight arrow groupings.

It is now with the larger aperture hunting peep sights a common problem presents itself with the best of archers having there arrow shot groupings falling apart. This is because they are now posed to a greater challenge, the loss of accuracy provided by a small peep with increased difficulty of consistent centering of the forward sight pin in the (center) of the larger aperture peep hole. This problem is obviously seen more prevalent with the larger aperture 3D and hunting larger styled aperture peep sights. Overall, there are few singular peep sight designs and available on the market to accommodate the need of both visibility and accuracy, but not without required changes and or adjustments of peep aperture diameter size. These few peep sights today all have required change of peep aperture size within its embodiment or with added interchangeable attachments. Today various types of adaptable peep sights have seen success within the market and usefulness among both target and hunting archery applications. However creative the designs are today, with peep hole size adaptability for small peep aperture target accuracy and large peep aperture for hunting lighting and vision improvement, each require changing from one to the other by the archer. And still today the larger peep aperture remains to sacrifice the accuracy provided by the smaller peep aperture sight hole most commonly used for target. A most useful improvement from having to change entire peep sight from bowstring having fore mentioned with peep aperture hole size adjustments are SAP Super Peep by Specialty Archery Products and Pick-a-Peep by Fine Line Inc. These two allow peep aperture size changes without removing peep embodiment from bowstring with varied aperture inserts as seen with the SAP Super Peep or slide adjustment within embodiment as seen with Pick-a-Peep.

However with this invention, peep aperture size changing or adjustments will not be required. With this invention, Fiber Optic Peep Sight provides the accuracy provided by that of a small peep aperture within a large peep aperture application with its added cross hair optic cross-pieces. This invention provides a visual, centered small index reference window for forward sight pin centering within its large peep aperture providing accuracy that of a smaller peep aperture, visibility of the larger peep aperture with increased accuracy attributed to novelty and method of use.

Several others, U.S. Pat. No. 5,148,603 (1992) by Beutler and U.S. Pat. No. 6,282,800 (2001) by also Beutler both vertically mounted, both effected by bow draw and axis length. However does attempt improved lighting within peep aperture, one by external source and the later by adjustable dial for varied lighting through peep aperture. Both above fail to provide unobstructed viewing subject bow draw and axial lengths as well elements subject to freezing in inclement field weather conditions.

U.S. Pat. No. 5,056,498 (1991) by Scherz provides a disc horizontally mounted with 3 slot providing two varied angular opposing conical surfaces of which provide a wider aperture peep viewing at full draw correcting problems with fore mentioned peep sights. However, application of dividing bowstring among three slots creates obstruction with bowstring in archers visual targeting through peep sight aperture. U.S. Pat. No. 5,325,598 (1994) by Hall provides a horizontally mounted peep sight structure with four slots for mounting in bowstring solving bowstring obstruction with featured adaptability peep aperture hole sizes provided by insert discs into embodiment receiving slot. It is these two prior art fore mentioned patents that demonstrates prior art inventor designs attempting to meet the need of both small and large peep aperture applications into a single piece instrument.

This invention does this with added design feature of optical 0.019 inch diameter color optic cross-pieces cross hair thus providing a small like peep index window centered within the large aperture peep sight. The index centering point is viewed in aperture center by the archer as a small see through optical colored pastel window created by the by optic cross-pieces attenuation and proximal blur induced to archer when viewed through at full draw position. Thus, now with this invention a large aperture peep sight overcomes and assists archer by providing a consistent centering reference for forward sight pin aperture centering and target point alignment. Fiber optics are readily available and have been widely use within the sporting industry as can be provided by South Coast Fiber Optics, Inc.

And last would be U.S. Pat. No. 5,996,569 (1999) by Wilson. Vertically mounted bowstring peep sight, with transparent plastic ambient light collecting fiber. Unlike the other prior art, Wilson's invention improvement light collecting fiber ends are utilized against a surface to help contrast the illumination point of forward sight pin against a surface within aperture reference. Problems with this design is the close proximity of archers eye with field of vision subjective to flare or blooming from fiber light collecting ends creating distortion of forward sight pin effecting visual alignment and thus accuracy. Additionally, problems with being vertically mounted as fore mentioned with prior art references.

This invention utilizes the optic cross-piece fibers as a side lit application attenuation verse end lit light collecting application. Nevertheless, all bowstring mounted peep sights heretofore known suffer from a number of disadvantages:

(a) Peep sight aperture hole is too small and field of vision is obstructed and lost during low lighting condition making it insufficient for archery hunting field conditions.

(b) Peep sight aperture hole is large for hunting application however arrow grouping and accuracy is lost with inconsistent forward sight pin centering within large peep aperture.

(c) Peep sight bowstring mounting and peep aperture hole does not properly align with various archers draw and bow axial lengths at full draw and viewing position.

(d) Adjustable peep sight aperture's peep size disc, insert or slide needs changing from one application to the other. Mechanical adjustable parts within embodiment are subject to the weather elements snow and ice with possible parts becoming frozen, dislodged, displaced or lost.

(e) Fiber optic light collecting fiber (ends), cause blooming or flare within close visual eye proximity at full draw thus causing difficulty sighting forward sight pin and target alignment.

OBJECTS AND ADVANTAGES

Accordingly, besides the objects and advantages described in prior art of bowstring mount peep sights, objects and advantage of the present invention are:

(a) To provide a large aperture peep sight permitting maximum targeting field of vision lighting and easy optical forward sight pin centering index system for consistent forward sight pin peep aperture centering.

(b) To provide archer a forward sight pin aperture centered index reference with natural color illumination from side lit optical fiber attenuation.

(c) To provide enhanced singular peep sight system for target, 3-D and hunting.

(d) To provide a singular one piece bowstring mounted peep sight acceptable to all bow draw and axial lengths, a full field of vision of objective target with enhanced optical fibers indexing aperture center for increased large aperture peep sight accuracy.

(e) To provide a peep sight with application to both target and hunting without needed required changing detachments or dial adjustments for peep aperture size adjustments.

(f) To provide light collecting side lit optical fiber cross hair aperture centering system for all archery applications providing consistent forward sighting pin aperture centering and illumination for early morning and late evening hunting hours.

(g) To provide a solid rubber coated peep sight embodiment enhancing peep sight bowstring security with rubberized gripping surface.

SUMMARY OF THE INVENTION

In accordance with the present invention is a generally horizontally mounted bowstring large aperture peep sight comprising side lit optic cross-piece elements, cross hair system centered within large peep sighting aperture opening secured within surrounding embodiment. Optic cross-piece elements, peep sight embodiment centrally located within bowstring axis provides an optical colored small center reference window in middle of large peep aperture for archers reference providing consistent and ease of forward sight pin centering within center of the large aperture style peep sight.

The novel features which are believed to be characteristic of the invention, both its organization and method of operation with further objective and advantages thereof, will be better understood from the following description and accompanying drawings in inventors preferred embodiment of the invention illustrated by way of example. It is to be expressly understood, however, that the drawings is for the purpose of illustration and description only and is not intended as a definition of the limits of the invention.

DRAWINGS-Reference Numerals

| | | | |
|---|---|---|---|
| 12 | fiber optic peep sight | 14 | peep sight aperture |
| 16 | slot | 18 | first face surface |
| 20 | second face surface | 22 | optic cross-piece |
| 24 | tubing | 26 | center index reference window |
| 28 | forward sight pin | 30 | target |
| 32 | slip knot | 34 | fiber light collecting end |
| 38 | adapter | | |

DETAILED DESCRIPTION OF THE PREFERRED EMBODIMENTS

Figure 1A:
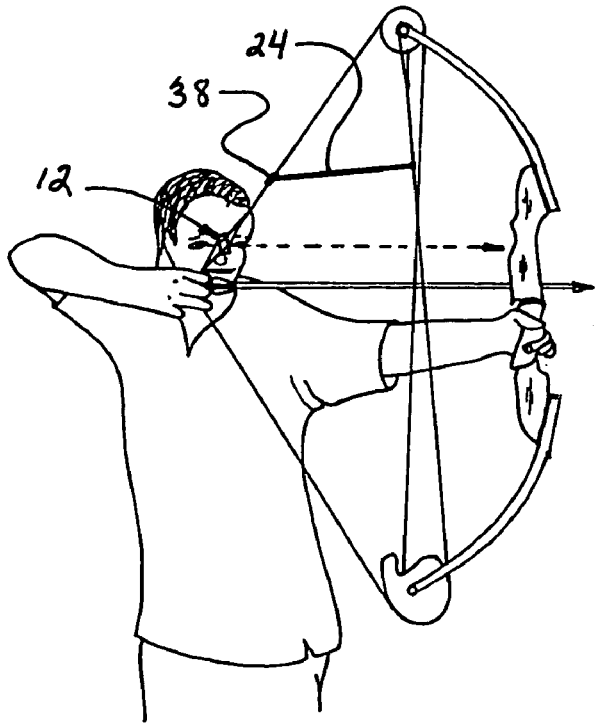
FIG. 1A is a side elevation view of the present invention archery peep sight mounted generally horizontal and canted approximately 30 degrees forward in a multi-strand bowstring illustrated cocked drawn position, shown with tubing and self alignment attachment FIG. 11 provided for illustration purposes.
Figure 2A:
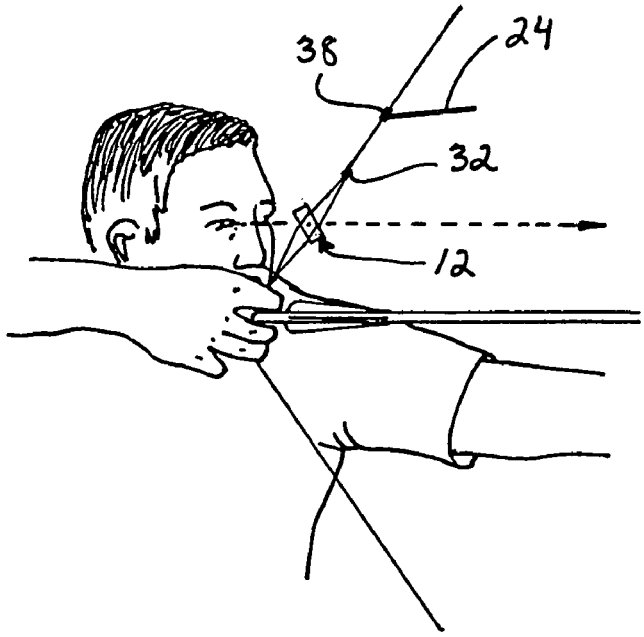
FIG. 2A is a side elevation view of the present invention peep sight mounted generally horizontal and canted approximately 30 degrees forward in a multi-strand bowstring illustrated cocked drawn position with archer sighting through the optic peep sight.
Figure 3A:
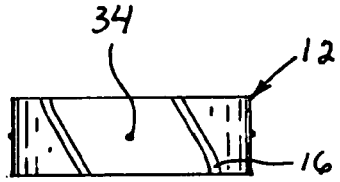
FIGS. 3A and 3B are side views of two embodiments of the present invention peep sight showing illustrated slots for insertion into multi-strand bowstring and optic cross-piece elements terminating through embodiment to outer perimeter sides of embodiment.
Figure 3B:
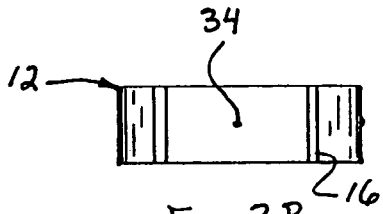
Figure 9A:
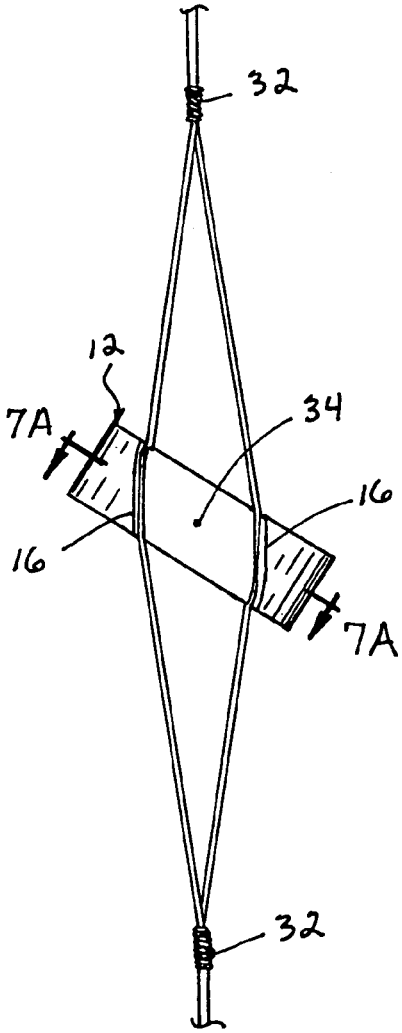
FIG. 9A is a pictorial view illustrating detail of optic peep sight securely mounted and served within bowstring further illustrating the centered aperture optic cross piece elements centering at bow string vertical axis.
Figure 10A:
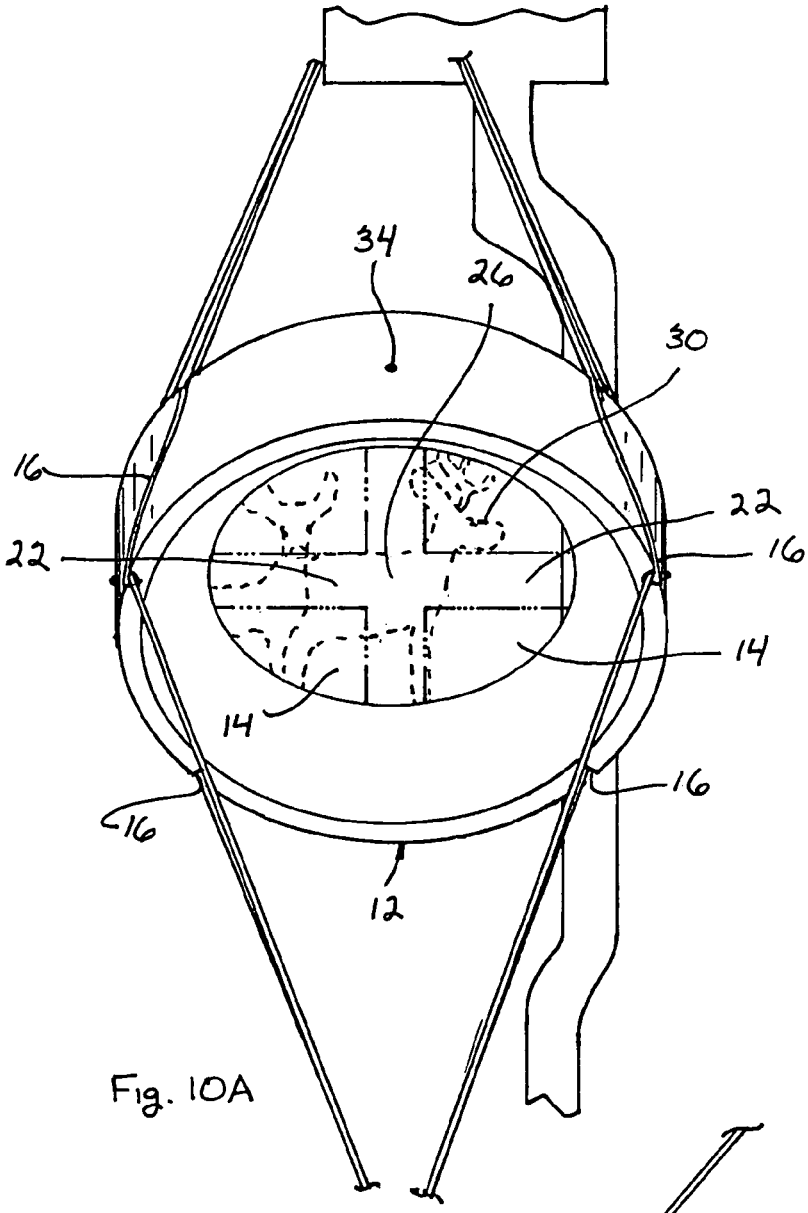
FIG. 10A is a pictorial view from archers sight plane at bowstring full cocked position looking through optic peep sight and objective target without forward sight pins.
Figure 12:
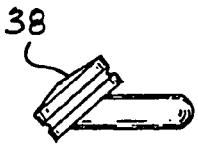
FIG. 12 is a bowstring alignment adapter shown for illustration purposes only used for peep sight rotational alignment.
Figure 13:
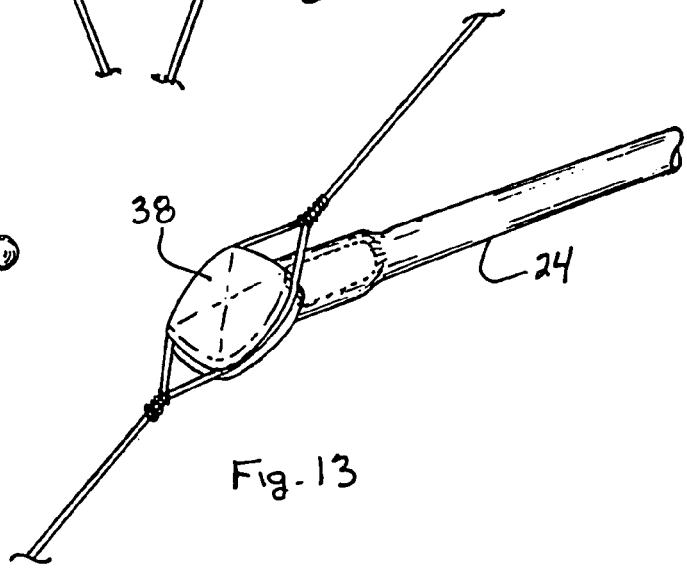
FIG. 13 is a pictorial view of bowstring alignment adapter and rubber tubing served within bowstring for illustration purposes only used for peep sight rotational alignment.
Figure 11A:
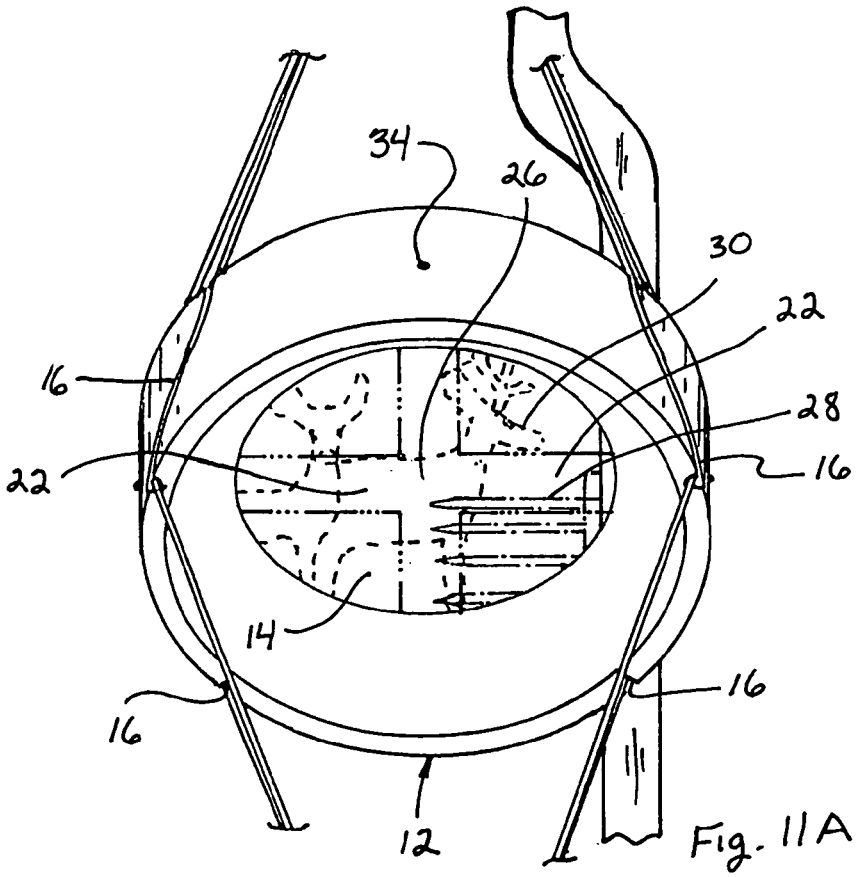
FIG. 11A is a pictorial view from archers sight plane at bowstring full cocked position looking through optic peep sight and objective target with forward sight pins.
Figure 14:
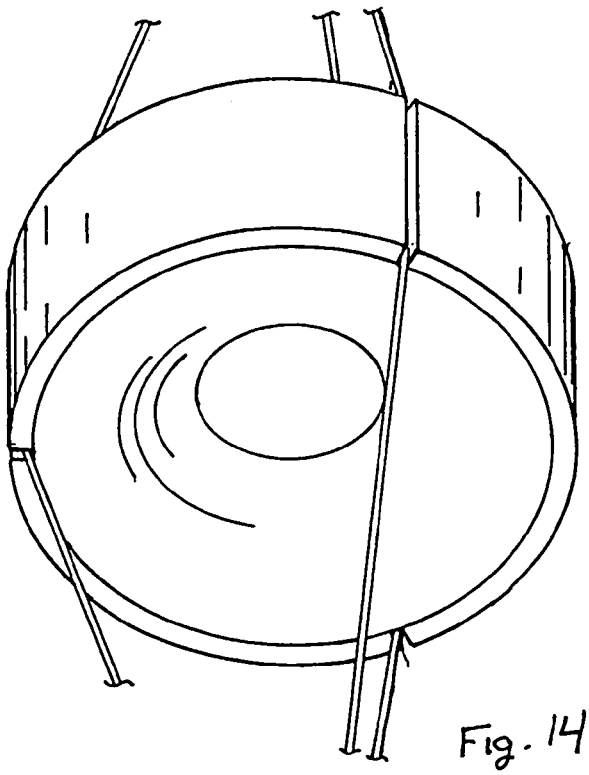
FIG. 14 is a pictorial illustration of archers sight plane at full cocked position looking through small to medium aperture style peep sight without objective target and forward sight pins for reference only.

A preferred embodiment of the present fiber optic peep is illustrated in FIG 1A though FIG. 11A. An understanding of the present invention can be readily gained by reference to FIG. 1A and FIG. 2A wherein side elevation views of the optic peep sight 12 mounted generally horizontal and canted 30 degrees in a multi-strand bowstring is shown. In FIG. 1A and FIG. 2A the archer has drawn the bowstring and it can further be seen the line of the bowstring axis, center peep sight aperture 14, optic cross-pieces 22 intersecting point are the same which can further be seen and illustrated FIG. 9A. In FIG. 2A the archer has drawn the bowstring in the full cocked and release position. In FIG. 2A the bowstring is drawn in full user cocked position, positioning optic peep sight 12 upward towards the archer such that it now becomes generally a vertical plane position permitting archer to view through peep sight aperture 14 across optic cross-pieces 22 illustrated in FIG. 10A and FIG. 11A.

In the preferred embodiment is a forward mounted archery sight having sight pins 28 attached to the bow riser and sighting accomplished by archer viewing through large peep sight aperture 14 centering forward archery sight pin 28 in centered optic cross-pieces 22 small index reference window 26 illustrated in FIG. 11A. This invention provides archer by means of close proximal blur, small visual index reference window 26 in peep sight aperture 14 center for forward sight pin 28 placement in aperture center aiding archers alignment onto objective point on the target 30 illustrated in FIG. 10A.

Figure 5A:
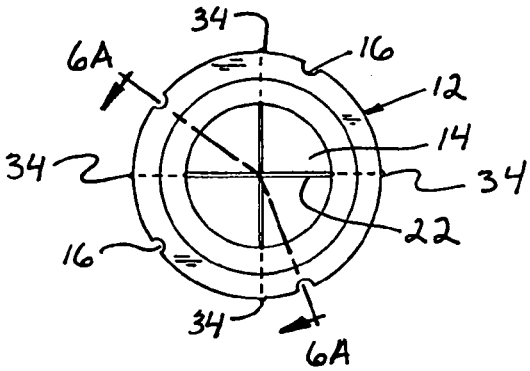
FIGS. 5A and 5B are top views corresponding, respectively, to FIGS. 3A, 4A and 3B, 4B of the optic peep sight preferred and alternate illustrating large diameter peep aperture and optic cross-piece elements within embodiment and slots for insertion into multi-strand bowstring.
Figure 5B:
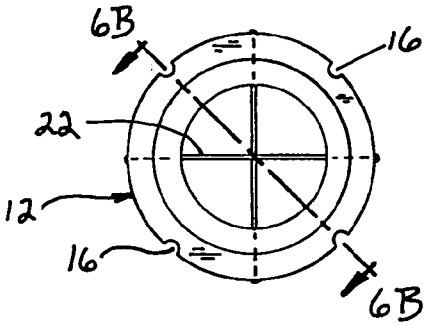
Figure 6A:
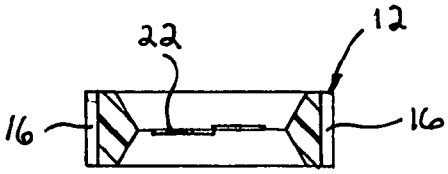
FIGS. 6A and 6B are vertical cross-sectional views, in accordance, respectively, with FIGS. 5A and 5B, of the optic peep sight embodiments showing shallow frustum-like body having first and second faces.
Figure 6B:
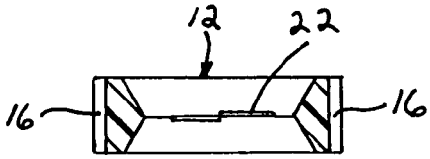
Figure 15:
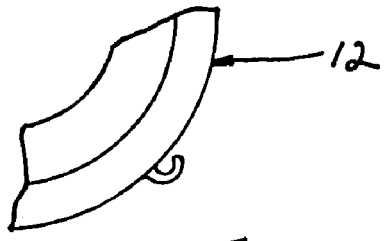
FIGS. 15 and 16 depict an alternative embodiment that utilizes strand engaging elements other than slots for engaging the strands of the bowstrings.
Figure 16:
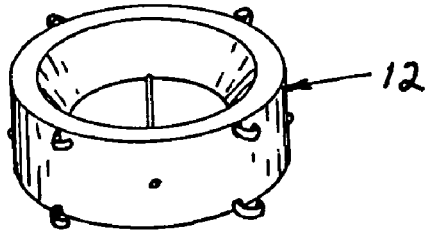
Figure 5C:
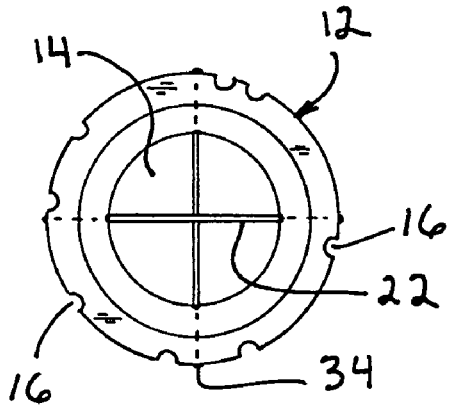
FIG. 5C is a similar view corresponding to FIG. 4C.
Figure 8A:
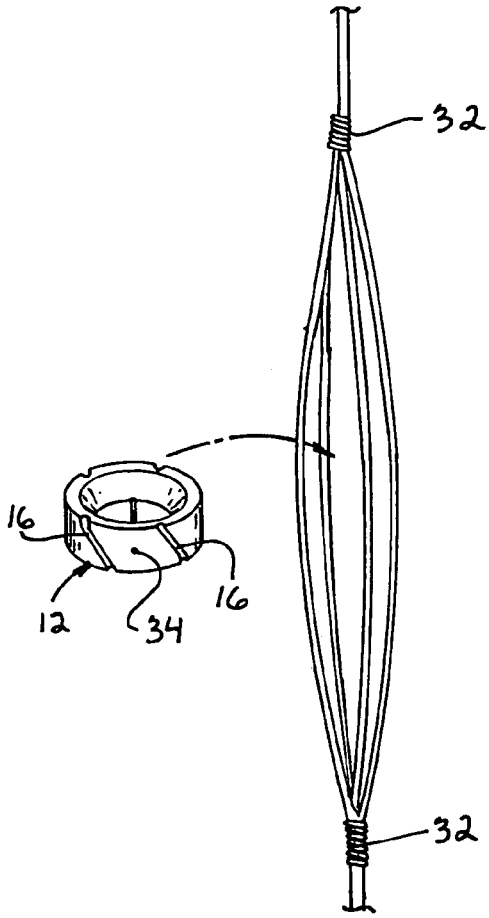
FIG. 8A is a pictorial view illustrating insertion of optic peep sight into multi-strand bowstring.
Figure 7A:
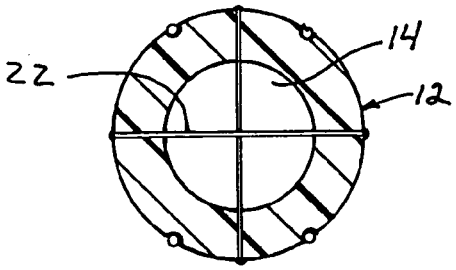
FIG. 7A is a top cross sectional view showing placement of optic cross-piece elements in relation to embodiment slots for insertion into multi-strand bowstring.

The optic peep sight 12 of the preferred embodiment is a disc shaped formed from a medium of plastics such as acrylic, PVC, polypropylene and polyethylene (HOPE, LOPE etc.) Polymers allow casting, dipping, coated, extruded or mold injected with or without LM (luminescent material). Embodiment of the present invention in polymers can be allowed for classical phosphorescent pigment loading for added luminescence as also the aperture overlapping cross-pieces reference 22. Although the peep sight embodiment can easily be formed from other type materials such as nylon, composite, styrene foam or aluminum, plastics deems most valuable in terms of production and long durability as well rubber coated for increased security within multi-strand bowstring. The optic peep sight 12 embodiment can be made of many different sizes although the preferred embodiment is approximately ⅝" to 11/16" diameter having a width approximately 3/16" to ¼". The optic peep sight 12 has a peep sight aperture 14 of which may vary in opening diameter about 5/16" to 7/16" inch with the larger more desirable for best visibility. The faces top frusto-conical surface 18 and bottom frusto-conical surface 20 (FIGS. 6A and 6B), of the optic peep sight 12 are preferably generally parallel have opposing inward recessions with frustum-like body intersecting with one another defining peep sight aperture 14. As can be further seen in FIGS. 5A, 5B, and 5C the optic cross-pieces 22 intersect forming a cross hair located equally within opposing and opposite paired slots 16 intersecting through the center of peep sight aperture 14. In this preferred embodiment optic peep sight 12 cross-pieces 22 terminate approximately equally through center of frustum-like body through four provided approximately 0.50 mm to 0.75 mm precision drilled holes located generally midway between first and second faces preferably secured with epoxy adhesive base mixture outside of frustum-like body at each optic cross-piece 22 light collecting end 36. Optic peep sight 12 optic cross-pieces 22 fiber light collecting ends 34 terminate slightly beyond flush of outer frustum-like body FIG. 7A. First and second face of frusto-conical recession 18 and 20 are tapered equally approximately between 35 to 45 degrees to equally deflect light and form inside of defined edge of peep sight aperture 14. Top view FIG. 5A, FIG. 5B, and FIG. 5C of the optic peep sight 12 shows the center location of the peep sight aperture 14 and approximately equal generally vertical uniformed distribution of slots 16 formed in the outer sides of the frustum-like body. These slots are designed to receive strands of the multi-strand bowstring illustrated in preferred FIG. 8A and again in preferred FIG. 9A. For purposes the slots may be of varying widths and depths but should be sufficiently large enough to accept tightly approximately one-fourth of the strands in the multi-strand bowstring.

Figure 4A:
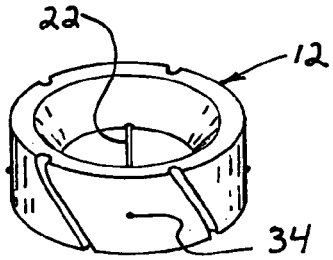
FIGS. 4A and 4B are pictorial views of two embodiments of the present invention corresponding, respectively, to FIGS. 3A and 3B, showing details of the optic peep sight preferred and alternate embodiment illustration of slots for insertion into multi-strand bowstring, each optic cross-piece extends through peep sight embodiment, aperture center and terminating outer side of peep sight embodiment equally between bowstring mounting slots.
Figure 4B:
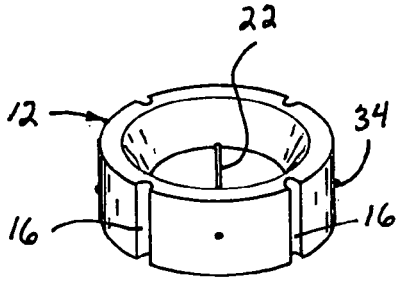
Figure 4C:
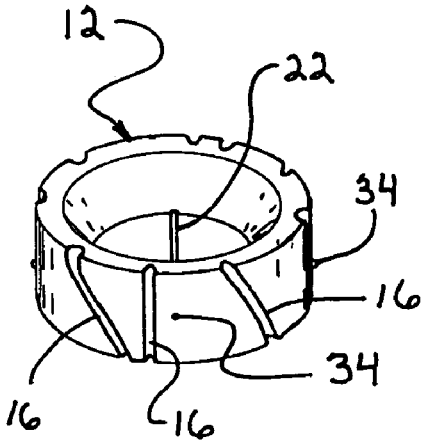
FIG. 4C is a similar view of another embodiment having features of both FIGS. 4A and 4B.

In the preferred and alternate embodiments FIG. 4A and FIG. 4B, the slots 16 are formed approximately 0.060 inch in width, which is the approximate width of an equal ¼ width of a multi-strand bowstring. The slots 16 depth approximately 0.065 inch and width approximately 0.060 inch illustrated in preferred and alternate figures extend over entire outer width of frustum-like body penetrating directionally toward center of peep sight aperture 14 opening coplanar to axis of frustum-like embodiment. Another alternate method of slots 16 for mounting optic peep sight 12 into multi-strand bowstring is a combination of both prior preferred and alternate figures and is illustrated in alternate embodiment FIG. 4C Alternate method of slots 16 FIG. 4C allows archer to increased angle of peep aperture viewing of which maybe desired with longbow applications. In the preferred and alternate embodiments, each pair of angled slots are separated approximately 0.250 to 0.300 of an inch apart with the horizontal and vertical optic fiber tubes 22 light collecting ends 36 terminating equally between. The fiber optic peep sight 12 is mounted by inserting it into the multi-strand bowstring at archer's predetermined position line of sight with archer's eye when the bowstring is fully drawn at user full cocked release position illustrated FIG. 2. At the appropriate position of the bowstring, the strands of the bowstring are divided into equal portion of strands as slots to receive the strands illustrated FIG. 7. With the strands of the bowstring inserted into slots 16, positioned and securely served in place with slip knots 32 the archer can easily sight through bowstring strands and peep sight aperture 14. Optic peep sight 12 alignment rotation can be aided if necessary with a peep sight bowstring alignment adapter 38 and rubber tubing 24 illustrated in FIG. 12, FIG. 13, FIG. 2 and FIG. 11.

The optic peep sight 12 is designed for ease of manufacture. It may be machined or molded. In the preferred embodiment, the optic peep sight 12 embodiment is formed with compatible plastics, delrin, polymer that would accept LM (luminescent material). Optic peep sight 12 optic cross-pieces 22 are of a fiber substance made with a core of polystyrene surrounded by a clear acrylic cladding. Special fluorescent dyes are preferably added to the core, where they absorb ultraviolet light and emit visible light through its ends and attenuation through its sides. Such as the fibers manufactured by South Coast Fiber Optics, Inc. Other materials can be used for optic cross-pieces 22, such as glow-in-dark fly line by Teeny Night Line Company and a fluorescent color glow in the dark fishing line.

Operation—FIGS. 1 through 11

The manner of using the Fiber Optic Peep Sight is similar to that for bowstring mounted peep sights in present use. Namely, securely mounted in bowstring the archer uses the peep sight for eye forward sight pin 28 and target 30 alignment as shown in sequence of operations FIG. 1, FIG. 2, FIG. 11 of my patent. Next, as archer is holding at full draw cocked position FIG. 2 optic cross-pieces 22 are seen through peep sight aperture 14 by archer as transparent fluorescent colored cross hair and an additional color highlighted aperture centered index reference window 26 provided by optic cross-pieces 22 overlapping each other. With user viewing through peep sight aperture 14 and resulting induced proximal blur vision of optic cross-pieces 22 index reference window 26 provides the archer with easy centering of forward sight pin within the large styled peep sight aperture 14. Through consistent aperture centering of forward pin sight 30 placement, the archer improves arrow groupings and increased overall accuracy.

Advantages

From the description above, a number of advantages of my fiber optic peep sight become evident:

(a) A larger viewing peep sight aperture provides maximum target viewing.

(b) A large viewing peep sight aperture provides maximum light for target viewing.

(c) The fiber optic florescent tube cross-pieces provide a small visual aperture center index reference window for optimum forward sight pin and peep aperture centering aiding archers forward pin alignment eliminating the common problem of inconsistent arrow groupings experienced today with large aperture style bowstring mounted peep sights.

(d) The fiber optic florescent tube cross-pieces assists the archer in centering forward sight pin thus from failing to center forward sight pin within peep aperture improving arrow accuracy and grouping.

CONCLUSION, RAMIFICATIONS, AND SCOPE

Accordingly, the reader will see that the large aperture fiber optic peep sight provides the archer over present like large aperture peep sights the accuracy advantage of a small peep hole aperture type without the loss of light and target viewing. Furthermore, the fiber optic peep sight has the additional advantage in that it provides the universal application for both target and hunting with no adjustments, attachments or need for changing over to a suitable peep sight, one for target and another for hunting application.

Additional embodiment FIGS. 3B through 5B is same as preferred embodiment with exception slots 16 are not offset 30 degrees from coplanar axis of peep embodiment being vertical with bowstring axis. Additional embodiment is less desirable for long bow applications however remains functional for shorter bowstring axial lengths associated with compound bows providing ample viewing angle at full draw cocked position.

Figure 17:
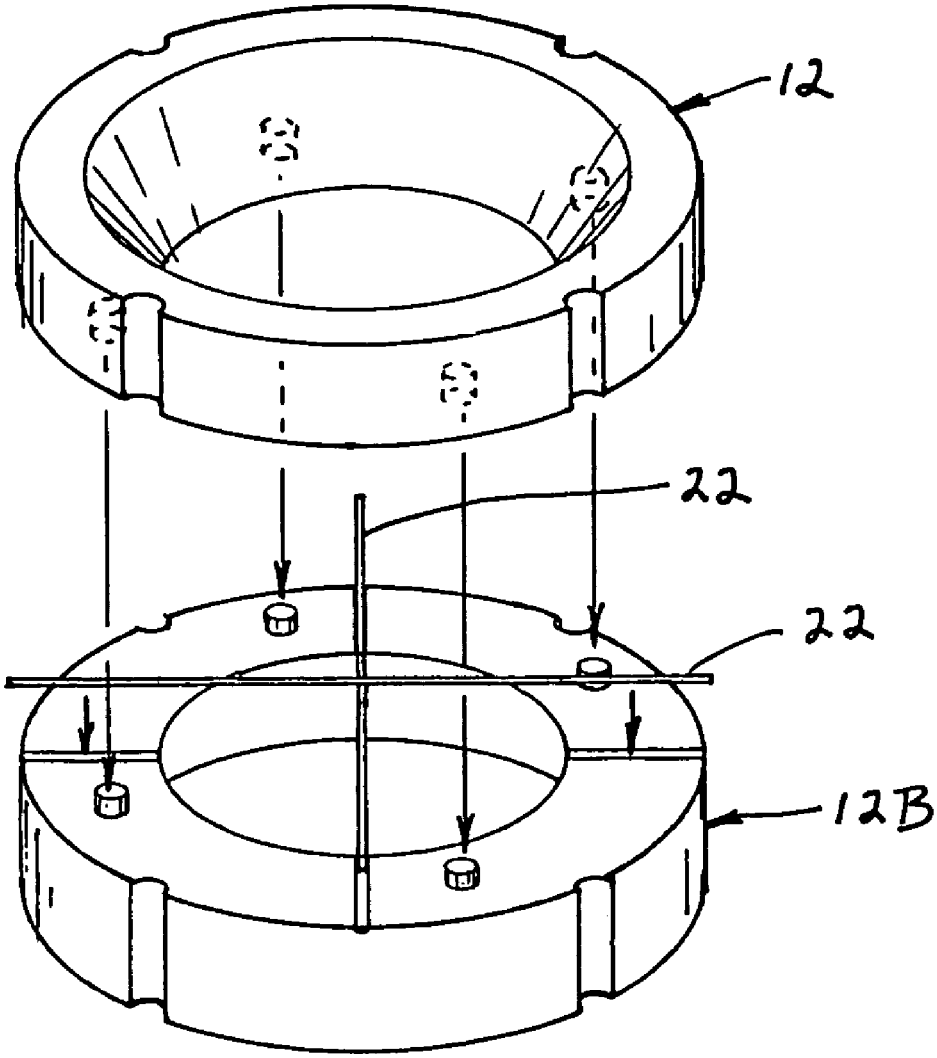
FIG. 17 depicts another alternative embodiment in which the peep sight is comprised of two separable components that may be matably joined to or engaged with one another when cross-piece elements are disposed between the separable components to form a completed peep sight.

The peep sight body can be formed in various ways and may be comprised of separable portions, such as is illustrated in FIG. 17, which separable components 12A and 12B can be assembled with the cross-piece elements 22 to form a completed peep sight assembly. The separable components may be designed to be joined to or to engage with one another, including by way of glues, epoxies, sonic welding, or other joinder devices and means, such as by snap-fit locking to one another, if desired, utilizing any commonly acceptable devices or methods for joining the components together to form the completed assembly.

It should also be understood that the method of aligning the archery bow forward sighting pin in the center of the bowstring mounted peep sight aperture, as described and discussed herein, makes use of what is referred to herein as induced proximal blur to the archer, but that other terms, including terms such as near point blur occurrence or similar terms may be utilized or employed to refer to the same or similar occurrences when sightings are performed with the bow and its mounted peep sight at a fully cocked position.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

Thus the scope of the invention should be determined by the appended claims and their legal equivalents, rather than by the examples given.

It should be understood and appreciated that the foregoing description and discussion has been directed principally towards a preferred embodiment of the invention and that identifications of or references to certain features, dimensions, or materials are not intended to limit the invention to constructions or embodiments that have such features, dimensions, or materials. Such identifications and references are intended to identify and describe certain features, dimensions, or materials whose use has been found advantageous, especially with regard to the preferred embodiments discussed, but not to otherwise be limiting in any regard. It will be understood and appreciated by those skilled in the art that other dimensions and materials can likewise or similarly be utilized to achieve and realize the advantages and objects of the invention, and it is the intention to encompass all such variations and changes, with protection for the invention being limited only by the claims which follow.

What is claimed is:

1. A peep sight for an archery bow having a multi-strand bowstring, comprising a shallow frustum-like body having first and second faces and a sighting aperture positioned extending through said frustum-like body between said first and second faces, at least four strand engaging portions distributed about the periphery of said frustum-like body, said frustum-like body being positionable generally cross-wise to the axis of the bowstring and with said strand engaging portions engaging separate strands of the multi-strand bowstring while the bowstring is in its nominal position with the bow uncocked, said strand engaging portions positioned to provide to a user a generally unobstructed sightline through the separated strands of bowstring and said sighting aperture as the bowstring its drawn back by the user and the frustum-like body is moved through an arc back toward the user, a pair of filamentary cross-pieces extending generally cross-wise across said sighting aperture and defining a generally centralized cross-hair location in said sighting aperture, said cross-pieces having light enhancement properties and being responsive to ambient light impinging upon the sides of said cross-pieces to luminesce, the view through the sighting aperture becoming open to view and the cross-hair location becoming visible to define a target peep as the bowstring is drawn back to the user to cock the archery bow, movement of the cross-pieces to a position near to the eye of the user when the bowstring is drawn back to the user inducing a proximal blur of said cross-pieces in the user's eyesight, the luminescing cross-pieces enhancing the viewability of the proximal blur when said cross-pieces are positioned near to the eye of the user, said cross-hair location appearing to the user, without necessity for an associated external power supply or artificial light source, when the bowstring has been drawn back to the user to cock the archery bow and said cross-pieces are positioned near to the eye of the user, as a luminescent proximal blur through which a desired target point is viewable for sighting and targeting, whereby the user can, when the bowstring has been drawn back to the user to cock the archery bow and without necessity for an associated external power supply or artificial light source even in low light conditions, sight upon a target and align a desired point in the line of sight with the luminescent proximal blur of said cross-hair location.

2. The peep sight of claim 1 wherein said cross-pieces are luminescent filaments.

3. The peep sight of claim 1 wherein said cross-pieces have light-emissive properties.

4. The peep sight of claim 1 wherein said cross-pieces are color optic fibers.

5. The peep sight of claim 4 wherein said optic fibers have a fiber optic cladding with a non-glare protective outer coating.

6. The peep sight of claim 4 wherein said optic fibers are responsive to ambient light to attenuate the ambient light through light absorption scattering to effect side light emission from said optic fibers.

7. The peep sight of claim 4 wherein said optic fibers have a light collecting material property.

8. The peep sight of claim 7 wherein said light collecting material property is a light collecting material pigment.

9. The peep sight of claim 7 wherein said light collecting material property is a light collecting material dye.

10. The peep sight of claim 1 wherein said cross-hair location remains essentially visually centered without regard to rotational displacements of the bowstring about its axis as the bow string is drawn and bow axial altered.

11. The peep sight of claim 1 wherein said frustum-like body is formed of a polymer-type material.

12. The peep sight of claim 11 wherein said polymer-type material has a rubberized coating material property.

13. The peep sight of claim 12 wherein said rubberized coating material property is a light collecting material pigment.

14. The peep sight of claim 1 wherein said frustum-like body includes opposed generally frusto-conical recessions extending inwardly into said frustum-like body from said first and second faces and intersecting with one another to define a peep hole.

15. The peep sight of claim 14 wherein said peep hole is located essentially midway between said first and second faces.

16. The peep sight of claim 15 wherein said first and second faces are spaced parallel to one another and said peep sight has an axis essentially perpendicular to the said first and second faces.

17. The peep sight of claim 1 wherein said strand engaging portions include slots for receiving strands of the multi-strand bowstring.

18. The peep sight of claim 1 wherein said strand engaging portions are rubberized and located to complementarily engage strands of the multi-strand bowstring to grip said peep sight at a fixed location along the bowstring to prevent slippage.

19. The peep sight of claim 1 wherein the bow includes a front sight associated with the bow and said cross-hair location is visually alignable with the front sight and with a distant target sight when the bowstring is drawn back to the user to cock the archery bow.

20. The peep sight of claim 1 wherein said strand engaging portions are disposed about said frustum-like body and spaced from one another to substantially fixedly hold said peep sight in position when separated strands of the multi-strand bowstring are engaged therewith and to space the engaged strands on opposite sides of the plane defined by the non-separated strands of the multi-string bowstring as the bowstring is drawn back by a user.

21. The peep sight of claim 20 wherein said strand engaging portions include slots for receiving strands of the multi-strand bowstring, each of said slots and a point on the axis of said frustum-like body defining a plane disposed angularly to the axis of said frustum-like body.

22. The peep sight of claim 21 wherein the angular relationship between said defined planes and the axis of said frustum-like body is that of an acute angle between said defined plane and the axis of the frustum-like body.

23. The peep sight of claim 22 wherein said acute angle is approximately 30 degrees.

24. The peep sight of claim 21 wherein said slots are non-uniformly disposed about said frustum-like body.

25. The peep sight of claim 20 wherein said strand engaging portions are disposed about said frustum-like body essentially uniformly.

26. The peep sight of claim 25 wherein said strand engaging portions include slots for receiving strands of the multi-strand bowstring, each of said slots being generally coplanar with the axis of said frustum-like body.

27. The peep sight of claim 26 wherein said frustum-like body is generally cylindrical and said slots are generally parallel to the axis of said frustum-like body.

28. The peep sight of claim 1 wherein said strand engaging portions are configured to hold said frustum-like body substantially perpendicular to the bowstring in its nominal position when separated strands of the multi-strand bowstring are engaged with said string engaging portions.

29. The peep sight of claim 1 wherein said strand engaging portions are configured to hold said frustum-like body at an acute angle relative to a perpendicular to the bowstring in its nominal position when separated strands of the multi-strand bowstring are engaged with said string engaging portions.

30. The peep sight of claim 29 wherein said acute angle is approximately 30 degrees.

31. The peep sight of claim 1 wherein said frustum-like body has a generally frusto-conical shape.

32. The peep sight of claim 31 wherein said frustum-like body has a generally uniform cross-sectional diameter.

33. The peep sight of claim 1 wherein the cross-sectional shape of said frustum-shaped body is that of a substantially conic section.

34. The peep sight of claim 1 wherein said frustum-like body is essentially disc-shaped.

35. The peep sight of claim 34 wherein the thickness of said frustum-like body is in the range of approximately 3/16" to 1/4".

36. The peep sight of claim 35 wherein the minimal cross-sectional dimension of said sighting aperture is at least approximately 5/16".

37. The peep sight of claim 36 wherein the minimal cross-sectional dimension of said sighting aperture is in the range of approximately 5/16" to 3/8".

38. The peep sight of claim 1 wherein said material of said body is opaque.

39. A bow and peep sight assembly comprising:

an archery bow and mounted multi-strand bowstring, and a peep sight mounted at an intermediate position along said bowstring, said peep sight having a shallow frustum-like body with first and second faces and a sighting aperture positioned extending through said frustum-like body between said first and second faces, at least four strand engaging portions distributed about the periphery of said frustum-like body, said frustum-like body positioned generally cross-wise to the axis of the bowstring while the bowstring is in its nominal position with the bow uncocked, said strand engaging portions positioned to provide to a user a generally unobstructed sightline through the separated strands of the bowstring and said sighting aperture as the bowstring its drawn back by the user and the frustum-like body is moved through an arc back toward the user, and a pair of filamentary cross-pieces extending generally cross-wise across said sighting aperture and defining a generally centralized cross-hair location in said sighting aperture, said cross-pieces having light enhancement properties and being responsive to ambient light impinging upon the sides of said cross-pieces to luminesce, the view through the sighting aperture becoming open and the cross-hair location becoming visible to define a target peep as the bowstring is drawn back to the user to cock the archery bow, movement of the cross-pieces to a position near to the eye of the user when the bowstring is drawn back to the user inducing a proximal blur of said cross-pieces in the user's eyesight, the luminescing cross-pieces enhancing the viewability of the proximal blur when said cross-pieces are positioned near to the eye of the user, said cross-hair location appearing to the user, without necessity for an associated external power supply or artificial light source, when the bowstring has been drawn back to the user to cock the archery bow and said cross-pieces are positioned near to the eye of the user, as a luminescent proximal blur through which a desired target point is viewable for sighting and targeting, whereby the user can, when said bowstring is drawn back to the user to cock the archery bow and without necessity for an associated external power supply or artificial light source even in low light conditions, sight upon a target and align a desired point in the line of sight with the luminescent proximal blur of said cross-hair location.

40. The assembly of claim 39 wherein said light enhancement properties of said cross-pieces enable said cross-pieces to be readily visible even under low light conditions to a user of said assembly as he sights through said sighting aperture when said bowstring is drawn back to the user to cock the archery bow.

41. The assembly of claim 40 wherein said frustum-like body is essentially disc-shaped.

42. The assembly of claim 41 wherein the thickness of said frustum-like body is in the range of approximately 3/16" to 1/4".

43. The assembly of claim 42 wherein the minimal cross-sectional dimension of said sighting aperture is at least approximately 5/16".

44. The assembly of claim 43 wherein the minimal cross-sectional dimension of said sighting aperture is in the range of approximately 5/16" to 3/8".

45. The assembly of claim 39 wherein said bow includes a sighting device attached to said bow generally intermediate the ends thereof, said sighting device including at least one sighting element, said peep sight and sighting device being so mounted relative to one another that a sighting element of said sighting device can be aligned with said cross-hair location of said peep sight when said bowstring is drawn back to the user to cock the archery bow and the user sights upon a target and aligns the cross-hair location of peep sight with a desired point in the line of sight.

46. The assembly of claim 45 wherein said sighting device includes a plurality of sighting elements and wherein a selected sighting element from among said plurality of sighting elements can be aligned with said cross-hair location of said peep sight when said bowstring is drawn back to the user to cock the bow and the user sights upon a target and aligns the cross-hair location of the peep sight with a desired point in the line of sight.

47. The assembly of claim 46 wherein said plurality of sighting elements include different colorings associated with different of said sighting elements to facilitate identification and selection of a desired sighting element from among said plurality of sighting elements.

48. The assembly of claim 39 including a peep sight alignment system comprising a peep sight alignment body having first and second faces and strand engaging portions for engaging separated strands of said multi-strand bowstring and for maintaining said separated strands apart from one another, a flexible member having a first end connected to said bow and a second end connected to said peep sight alignment body, said peep sight alignment body disposed along said multi-strand bowstring at a location spaced from said mounted peep sight, whereby said peep sight alignment system serves to minimize rotational displacement of said bowstring and said mounted peep sight as said bowstring is moved through an arc back toward the user.

49. The assembly of claim 48 wherein said peep sight alignment body is a generally disc-shaped body having a side perimeter, a slot formed along at least portions of said side perimeter, said slot sized to receive and hold separated strands of said multi-strand bowstring.

50. The assembly of claim 49 wherein said disc-shaped body includes a projecting pin on the side of said body facing said bow and said flexible member is a length of rubber tubing, the interior diameter of said rubber tubing being sized to complementarily frictionally engage the outer surface of said projecting pin.

51. A method, for use with an archery bow and a mounted projectile, for aligning an archery bow forward sighting element and the center of a bowstring mounted peep sight aperture and for targeting a desired target point without the need for an external power supply or artificial light source to be associated with the bow or peep sight for illumination thereof, comprising:

(a) providing an archery bow having a forward sighting element mounted along the bow and a peep sight mounted along the reach of the bowstring, said peep sight comprising a frustum-like body of material having a peep sighting aperture extending therethrough including a generally centralized cross-hair element within said peep sighting aperture, said cross-hair element having light enhancement properties and being responsive to ambient light impinging thereupon to luminesce, said body being disposed generally cross-wise to the axis of the bowstring while the bowstring is in its nominal position with the bow uncocked said body being maintained in position along said reach of the bowstring by separated strands of the bowstring distributed about the periphery of said body, said centralized cross-hair element having light enhancement properties and being responsive to ambient light impinging upon the sides thereof to luminesce, said centralized cross-hair element defining a visual communicating centering reference for a user within said peep sighting aperture, (b) drawing the bowstring and the mounted peep sight back toward the eye of the user to move the peep sight mounted thereto along an arc back toward the eye of a user to open the sighting aperture to viewing therethrough and to bring into view through said sighting aperture a forward objective target, movement of the cross-hair element to a position near to the eye of the user when the bowstring is drawn back to the user inducing a proximal blur of said cross-hair element in the user's eyesight, the luminescing cross-hair element enhancing the viewability of the proximal blur when said cross-hair element is positioned near to the eye of the user, said cross-hair element appearing to the archer, without necessity for any associated external power supply or artificial light source, as a luminescent proximal blur through which said sighting element and a forward objective target are viewable for sighting and targeting as the bowstring is drawn back to the archer to cock the bow to open the view through the peep sighting aperture for centering of the bow forward sighting element with said cross-hair element, (c) sighting on a desired point of the forward objective target and said bow forward sighting element through the luminescent proximal blur of said cross-hair element at full user cocked position and aligning said visual communicating centering reference of the peep sighting aperture and said forward sighting element aligned with the desired point of the objective target, whereby, said bow forward sighting element can be easily aligned with the centralized cross-hair element and can be consistently sighted on an objective target point within the user's field of view without the necessity for an associated external power supply or artificial light means even under low light conditions.

52. The method of claim 51 wherein the sighting of said visual communicating centering reference within the peep sight aperture on the objective target is effected by viewing the objective target point through an induced proximal blur made visible to the archer when the bow is at its user full cocked position, said induced proximal blur resulting from the viewed appearance of the cross-hair element composed of colored attenuating optical fibers in the peep sighting aperture as the bowstring is drawn back to the archer.

* * * * *